US009574422B2

(12) United States Patent
Adam et al.

(10) Patent No.: US 9,574,422 B2
(45) Date of Patent: Feb. 21, 2017

(54) FORMATION TREATMENT SYSTEM

(71) Applicants: Mark Kendall Adam, Houston, TX (US); Michael H. Johnson, Katy, TX (US); Nicholas J. Clem, Houston, TX (US); Jason A. Allen, Houston, TX (US)

(72) Inventors: Mark Kendall Adam, Houston, TX (US); Michael H. Johnson, Katy, TX (US); Nicholas J. Clem, Houston, TX (US); Jason A. Allen, Houston, TX (US)

(73) Assignee: BAKER HUGHES INCORPORATED, Houston, TX (US)

( * ) Notice: Subject to any disclaimer, the term of this patent is extended or adjusted under 35 U.S.C. 154(b) by 738 days.

(21) Appl. No.: 13/914,702

(22) Filed: Jun. 11, 2013

(65) Prior Publication Data

US 2014/0014347 A1 Jan. 16, 2014

Related U.S. Application Data

(60) Provisional application No. 61/671,530, filed on Jul. 13, 2012.

(51) Int. Cl.
*E21B 34/14* (2006.01)
*E21B 43/26* (2006.01)
(Continued)

(52) U.S. Cl.
CPC ..... *E21B 34/14* (2013.01); *E21B 23/006* (2013.01); *E21B 34/12* (2013.01); *E21B 43/08* (2013.01); *E21B 43/26* (2013.01)

(58) Field of Classification Search
CPC ..... E21B 34/14; E21B 2034/007; E21B 43/26
(Continued)

(56) References Cited

U.S. PATENT DOCUMENTS 7,748,459 B2 7/2010 Johnson
2005/0006106 A1 1/2005 Hirth et al.
(Continued)

FOREIGN PATENT DOCUMENTS

WO 2011057416 A1 5/2011

OTHER PUBLICATIONS

International Search Report and Written Opinion, Date of Mailing Sep. 25, 2013, International Application No. PCT/US2013/04557, Korean Intellectual Property Office, Written Opinion 7 pages, International Search Report 3 pages.
(Continued)

*Primary Examiner* — George Gray
(74) *Attorney, Agent, or Firm* — Cantor Colburn LLP

(57) ABSTRACT

A treatment system including a first tubular having at least one port therein. A valve member is disposed with the first tubular and operatively arranged to control fluid flow through the at least one port. A second tubular is disposed radially within the first tubular and terminates at an end opening into an interior passage of the first tubular for enabling a treatment media to be supplied through the second tubular into the first tubular, and through the at least one port when the at least one port is open. A seal assembly is disposed between the first and second tubulars for fluidly sealing an annulus formed between the first and second tubulars from the end of the second tubular. A tool is disposed with the second tubular for controlling operation of the valve member.

19 Claims, 2 Drawing Sheets

(51) Int. Cl.
*E21B 43/08* (2006.01)
*E21B 23/00* (2006.01)
*E21B 34/12* (2006.01)

(58) Field of Classification Search
USPC ..... 166/373, 316, 334.4, 308.1
See application file for complete search history.

(56) References Cited

U.S. PATENT DOCUMENTS

| | | | | |
|---|---|---|---|---|
| 2005/0279501 | A1* | 12/2005 | Surjaatmadja | E21B 34/14 166/278 |
| 2006/0005964 | A1* | 1/2006 | Jannise | E21B 41/00 166/244.1 |
| 2007/0051507 | A1* | 3/2007 | Ross | E21B 34/06 166/51 |
| 2007/0151735 | A1* | 7/2007 | Ravensbergen | E21B 17/203 166/308.1 |
| 2009/0044944 | A1* | 2/2009 | Murray | E21B 43/02 166/308.1 |
| 2009/0301708 | A1* | 12/2009 | Savoy | E21B 43/26 166/186 |
| 2010/0163235 | A1 | 7/2010 | Mootoo et al. | |
| 2011/0000679 | A1 | 1/2011 | Joseph et al. | |
| 2012/0085548 | A1 | 4/2012 | Fleckenstein et al. | |
| 2012/0325484 | A1* | 12/2012 | Patel | E21B 34/14 166/308.2 |

OTHER PUBLICATIONS

Halliburton, [online]; [retrieved on Aug. 29, 2013]; retrieved from the Internet http://www.halliburton.com/public/cps/contents/Books_and_Catalogs/web/SandControl/Section2_Downhole_Tool_Systems.pdf , "Downhole Tool Systems", pp. 22.

* cited by examiner 10
12
14
16
18
20
22
24
26
28
30
32
34
36
38
40
42
44
46
50
52

FORMATION TREATMENT SYSTEM

CROSS REFERENCE TO RELATED APPLICATIONS

This application claims the benefit of an earlier filing date from U.S. Provisional Application Ser. No. 61/671,530 filed Jul. 13, 2012, the entire disclosure of which is incorporated herein by reference.

BACKGROUND

Fracturing and other formation treatment operations are ubiquitous in the downhole drilling and completions industry. In many fracturing operations a work string is run within an outer tubular string and includes a tool for controlling the operation of one or more valves to selectively permit fluid communication between the interior and exterior of the tubular string. These tools are widely used, taking a variety of forms, and are generally sufficient for performing the tasks for which they were designed. However, as with most technology, these tools may have deficiencies, tradeoffs, or limitations, such as requiring the valve to remain open while reversing out proppant slurry, the need to move the tool in both the downhole and the up-hole directions to close the valve after the fracturing or treatment, and so on. The industry is always desirous of alternatives in downhole treatment systems, specifically hydraulic fracturing systems, and would well receive new systems to alleviate the aforementioned and other drawbacks in currently used systems.

SUMMARY

A treatment system, including a first tubular having at least one port therein; a valve member disposed with the first tubular and operatively arranged to control fluid flow through the at least one port; a second tubular disposed radially within the first tubular and terminating at an end opening into an interior passage of the first tubular for enabling a treatment media to be supplied through the second tubular into the first tubular, and through the at least one port when the at least one port is open; a seal assembly disposed between the first and second tubulars for fluidly sealing an annulus formed between the first and second tubulars from the end of the second tubular; and a tool disposed with the second tubular for controlling operation of the valve member.

A method of performing a treatment operation including positioning an inner tubular within an outer tubular, the outer tubular having at least one port therein and a valve member for controlling flow through the at least one port, the inner tubular having a tool for controlling actuation of the valve member, the inner tubular terminating at an end opening into an interior passage of the outer tubular; engaging a seal assembly between the inner and outer tubulars, the seal assembly sealing off an annulus formed between the inner and outer tubulars from the end of the inner tubular; actuating the valve member with the tool in order to control fluid flow through the at least one port; and supplying a treatment media through the inner tubular into the interior passage via the end of the inner tubular and through the at least one port when the at least one port is open.

A treatment system, including a first tubular having at least one port therein; a valve member disposed with the first tubular and operatively arranged to control fluid flow through the at least one port; a second tubular disposed radially within the first tubular and terminating at an end opening into an interior passage of the first tubular for enabling a treatment media to be supplied through the second tubular into the first tubular, and through the at least one port when the at least one port is open; a filter assembly disposed between the first and second tubulars operatively arranged to permit fluid flow from the end of the second tubular into an annulus formed between the first and second tubulars while substantially blocking passage of solids therethrough; and a tool disposed with the second tubular for controlling operation of the valve member.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
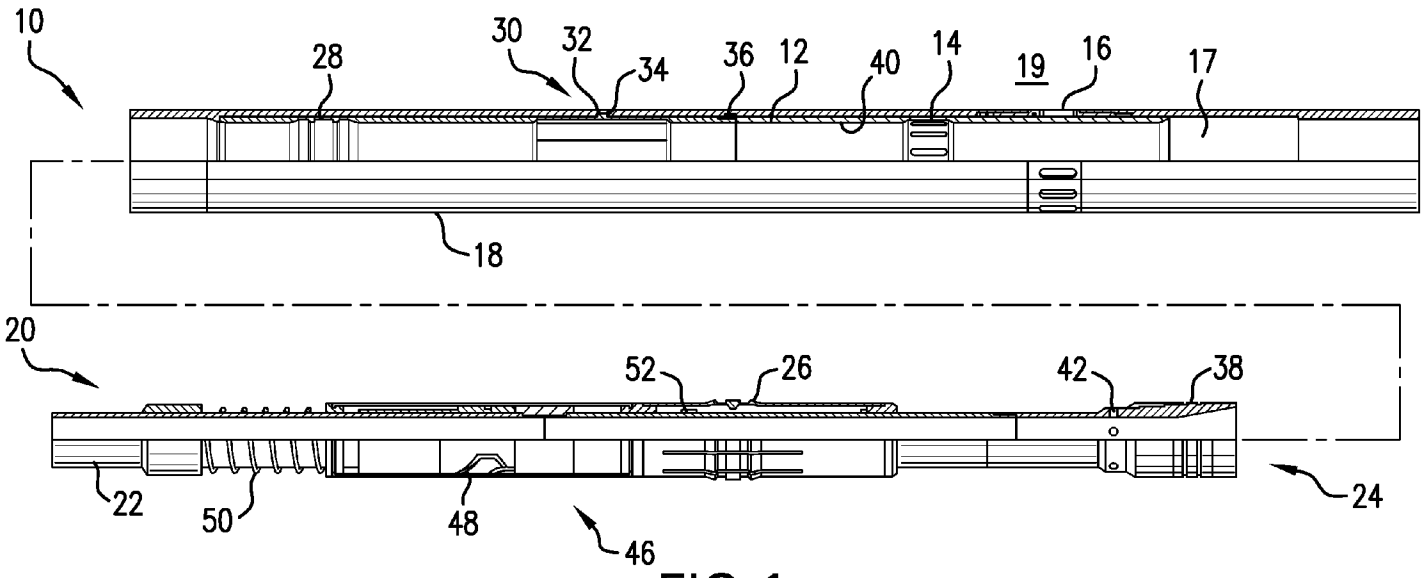
FIG. 1 is an exploded quarter-sectional view of a system according to one embodiment disclosed herein.
Figures 2, 3, 4, 5:
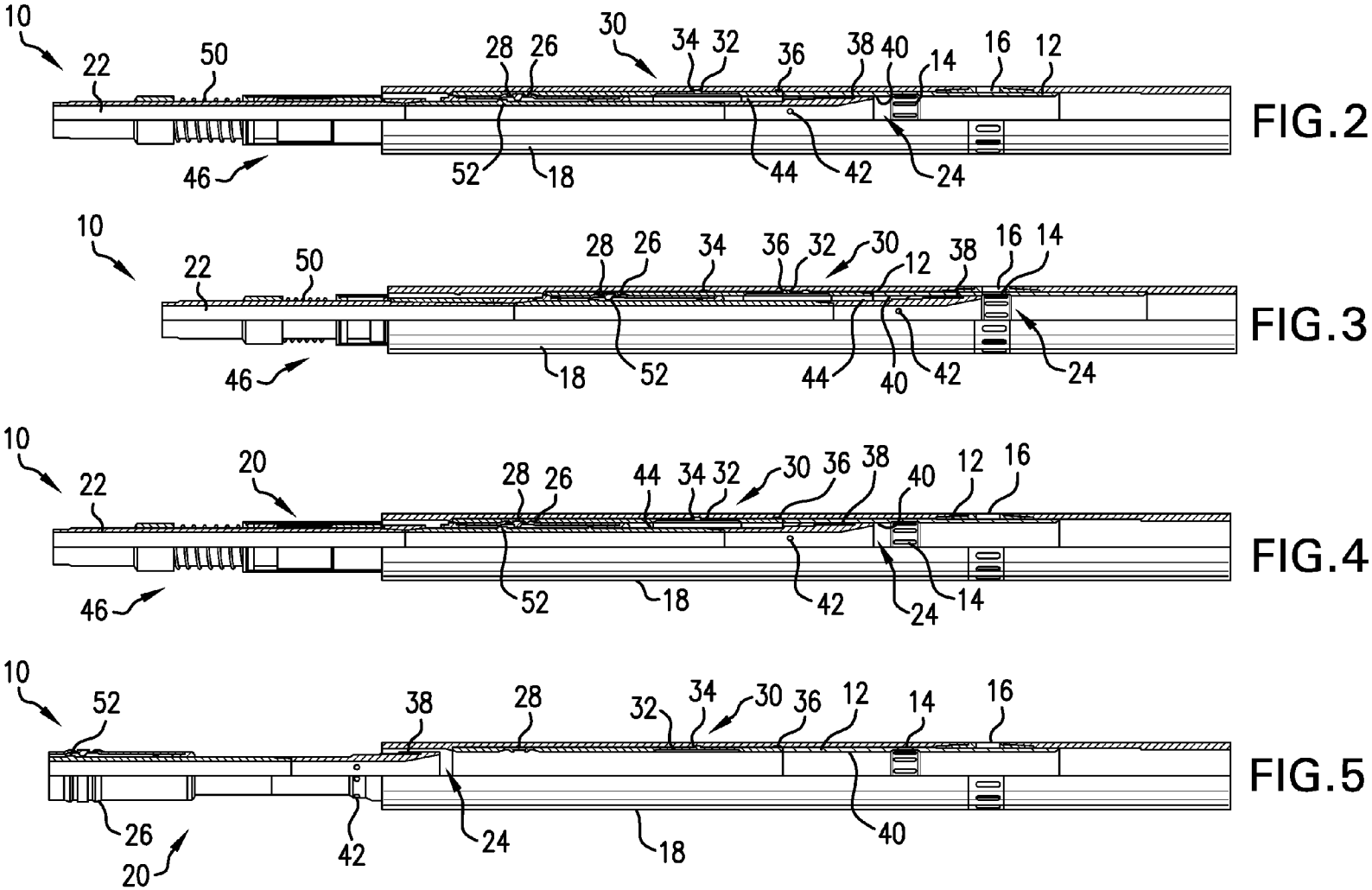
FIG. 2 is a quarter-sectional view of the system of FIG. 1 having a sleeve in a closed position.
FIG. 3 is a quarter-sectional view of the system of FIG. 1 having the sleeve is an open position.
FIG. 4 is a quarter-sectional view of the system of FIG. 1 with the sleeve being reclosed.
FIG. 5 is a quarter-sectional view of the system of FIG. 1 with an inner string being pulled out.

Referring now to FIG. 1, a system 10 is shown including a valve in the form of a sleeve 12 having a set of inner ports 14 alignable with a set of outer ports 16 in a tubular string 18 for controlling a flow of fluid between an interior passageway 17 and an exterior area 19 of the string 18. That is, the sleeve 12 is movable with respect to the string 18 in order to control fluid flow through the ports 16, e.g., to selectively open and close the ports 16. The sleeve 12 is shown in a closed position in FIG. 1 in which the ports 14 and 16 are misaligned and therefore fluid communication through the ports 16 and 18 is not permitted. An open position for the sleeve 12 is shown in FIG. 3 and discussed in more detail below. It is noted at the outset that while the term "sleeve" is used throughout the current disclosure, that the sleeve 12 could be substituted by other valve members, e.g., a flapper or ball, take other forms, e.g., have a non-tubular shape, be actuated in other directions, e.g., rotationally, and that one of ordinary skill in the art would readily appreciate the modifications necessary to implement those valve members in lieu of the sleeve 12.

In one embodiment, the string 18 is arranged in a borehole with the exterior area 19 being related to a hydrocarbon bearing zone, interval, or formation for enabling the production or stimulation of hydrocarbons when the ports 14 and 16 are aligned (i.e., when the sleeve 12 is in the open position). The borehole can be open hole, cased, lined, etc. The sleeve 12 is selectively openable and closable such that the formation proximate to the ports 16 is able to be fractured by pumping pressurized fluid through the ports 16 when the sleeve 12 is shifted open. Thereafter shifting the sleeve 12 closed enables another zone to be fractured, e.g., via another valve resembling the sleeve 12 and located proximate to another interval or zone, with all of the sleeves/valves openable after fracturing to enable production from multiple zones (or another set of sleeves/valves, with the sleeve 12 only opened once during treatment/stimulation, etc.). While fracturing is an example of one operation that benefits from the current invention as described herein, one of ordinary skill in the art will appreciate that any other treatment requiring selective control of a treatment media or fluid to a formation will benefit from disclosed embodiments.

In order to shift the sleeve 12 between its open and closed positions (respectively aligning and misaligning the ports 14 and 16) a service tool 20 is provided on a work string 22 that terminates at an end 24. In the illustrated embodiment, the tool 20 is open-ended. By open-ended, the end 24 opens axially into the interior 17 of the tubular string 18, unlike prior art tools which communicate from the tool into the primary string radial ports that are sealed on opposite axial sides. By providing direct axial flow from the work string 22 into the outer string 18, a high rate of flow can be achieved, as the opening is completely unobstructed and the flow is not forced to turn, i.e., from an axial direction down the string 22, into a radial direction through radial ports. Furthermore, by avoiding radial ports or other obstructions that cause or require the flow to turn, abrasion on and erosion of the tool 20 and the work string 22 can be reduced, lengthening the life of these components. Of course, it is noted that the tool 20 in some embodiments is not opened-ended (e.g., includes radial ports), and that many of the advantages discussed herein would still be applicable (e.g., being able to directly pull out the tool as discussed below).

The tool 20 includes a collet 26 that is engageable with a corresponding profile 28 in the sleeve 12. One of ordinary skill in the art will recognize that the collet 26 could be substituted by other selectively releasable members, e.g., biased dogs or the like. Engaging the collet 26 with the profile 28 enables movement of the collet 26 to control the open/closed status of the sleeve 12. A latch mechanism 30, in the form of a collet 32 releasably engageable with a pair of recesses 34 and 36, enables the sleeve 12 to be securely held in the open and closed positions, respectively, until some predetermined threshold force is exerted on the sleeve 12 to release the collet 32. That is, when the sleeve 12 is in the closed position, as shown in FIGS. 1 and 2, the collet 32 is engaged in the recess 34 and some predetermined force must be exerted on the sleeve 12 in order to open the ports 16. Similarly, when the sleeve 12 is shifted to its open position, the collet 32 becomes engaged with the recess 36, as shown in FIG. 3, and held there until some predetermined force is exerted on the sleeve 12 to shift the sleeve 12 and close the ports 16. In this way, the sleeve 12 will not inadvertently actuate, e.g., due to friction when a tool or component other than the tool 20 is run through the sleeve 12.

The open-ended service tool 20 includes a seal assembly in the form of one or more seal elements 38 that sealingly engage a seal bore 40 of the sleeve 12. The tool 20 is shown sealingly engaged with the sleeve 12 in FIG. 2. It is noted that in the illustrated embodiment, the seals 38 are located relative to the ports 16 in the same direction in which the work string 22 is to be removed, i.e., the seals 38 are located up-hole of the ports 16. Advantageously, the work string 22 does not need to move in the downhole direction (as in prior systems) and can be directly pulled out of the sleeve 12 for removal from a borehole or engagement with another sleeve/valve located up-hole for fracturing or treating another zone. Furthermore, it is noted that since the tool 20 is actively engaged with the sleeve 12 during treatment, that pulling out the tool 20 automatically closes the sleeve 12 and can be performed essentially immediately after treatment through the ports 16 is completed.

The tool 20 also includes one or more filter plugs 42 for permitting fluid communication between the interior of the work string 22 and an annulus 44 formed between the work string 22 and string 18 (and/or the sleeve 12). The filter plugs 42 could be mesh or screens, permeable materials such as foams, packs formed from pellets or beads, etc. This fluid communication enables, e.g., fluid pressure in the annulus 44 to be monitored at surface, which information may aid operators during fracturing and other treatment operations. While permitting fluid flow, the filter plugs 42 are specifically arranged to prevent the passage of sand, granules, and other significantly sized solids in the treatment media therethrough (the term "solids" being used generally herein). In this way, for example, after opening the ports 16 (by shifting the sleeve 12 with the collet 26 of the tool 20), a proppant slurry, high pressure fracturing fluid, or other operating media (e.g., fluids, solids, flowable solids, combinations thereof, etc.) can be pumped down the work string 22 and communicated to the formation via the ports 16 for treating (fracturing) the formation without solids in the slurry being able to travel into the annulus 44. In this way, the seals 38 (moving through the space previously occupied by the annulus 44, which is debris-free due to the plugs 42) can be smoothly pulled out of the sleeve 12 without the risk of sand or other proppant solids becoming frictionally engaged, wedged, or jammed between the string 22 and the sleeve 12 or other parts of the string 18. As noted above, this drastically decreases the likelihood of the work string 22 becoming stuck in the string 18 as the work string 22 is pulled out.

In the illustrated embodiment, the tool 20 includes an indexing mechanism 46 coupled to the collet 26 to cycle the collet 26 between at least two pre-determined positions relative to the work string 22. For example, in the illustrated embodiment, the mechanism 46 includes a J-slot pattern 48 in which a lug, pin, or other protrusion extending between the string 22 and the collet 26 (or a sleeve connected thereto) travels in order to permit a predetermined degree of relative movement between the collet 26 and the work string 22. A spring 50 is included to bias the collet 26 in one direction relative to the string 22 to ensure that the collet 26 is moved to and held in the aforementioned pre-determined positions. Specifically, as can be seen by comparing the configurations illustrated in FIGS. 2 and 3, the pre-determined positions set by the indexing mechanism 46 enables a support 52 to be positioned relative to the collet 26 to selectively support the collet 26. Specifically, when supported by the support 52 (as shown in FIG. 3), the collet 26 is unable to flex radially inwardly and can not feasibly be released from engagement with the profile 28, thus enabling the sleeve 12 to be shifted by the string 22 via the engagement with the collet 26 without the risk of the collet 26 releasing.

One example of operating the sleeve 12 with the tool 20 is given below with respect to FIGS. 2-5. In FIG. 2, the string 22 is shown with the collet 26 of the tool 20 engaged with the profile 28 of the sleeve 12. It is noted that depending on the configuration of J-slot pattern 48 and/or the indexing mechanism 46, prior to the configuration shown in FIG. 2, the collet 26 may have to first be engaged with and then disengaged from the profile 28 while traveling in the downhole direction (toward the ports 16). For example, as can be seen in FIG. 2, the collet 26 is engaged against the up-hole shoulders of the profile 28, as FIG. 2 depicts the string 22 as it is being pulled back up through the sleeve 12. First inserting the tool 20 through the sleeve 12 triggers the indexing mechanism 46 to cycle between the unsupported and supported positions for the support 52 (as delimited by the J-slot pattern 48), shown in FIGS. 2 and 3, respectively. Specifically, sufficient force exerted in the downhole direction by the work string 22, e.g., via set down weight, will cause the indexing mechanism to cycle between the two above-noted predetermined positions when the downhole-directed force is released (e.g., as shown in FIG. 2) and then reapplied (e.g., as shown in FIG. 3). If multiple valves or copies of the sleeve 12 are provided along the length of the string 18, e.g., for enabling the fracture or treatment of a number of zones, the above-noted operation enables the tool 20 to be run-in through selected ones of the sleeves 12 without triggering those sleeves (e.g., for enabling a bottom-most zone to be fractured first, followed successively by each subsequent up-hole zone).

After engaging the tool 20 with the sleeve 12, a force can be applied to the string 22, e.g., by slacking off weight. As shown in FIG. 3, the reapplication of force in the downhole direction cycles the indexing mechanism 46, as described above, causing the support 52 to radially support the collet 26 (if previously in the unsupported position). Once supported by the support 52, the sleeve 12 is locked to the string 22 such that the sleeve 12 can be shifted in the downhole direction by the string 22 via the connection at the tool 20. It can be verified that the support 52 is in the supporting position and the sleeve 12 is moved to its open position by slacking off by a value substantially greater than that needed to release the collet 26 from the profile 28 when unsupported (as one example, the collet 26 can be set to release at 30,000 lb when unsupported and the string 22 can be slacked off 100,000 lb to verify). If the collet 26 does not release when this elevated force is exerted thereon, then it can confidently be determined that the indexing mechanism 46 is properly in the support position and that the sleeve 12 has been shifted to open the ports 16. Once the ports 16 are opened, fracturing proppant or other treatment media can be pumped down the work string 22 directly through the open end 24 to the ports 16 in order to fracture or otherwise treat the formation proximate to the area 19.

After fracturing or performing another treatment operation, the treatment media will be located solely in the string 22, the tool 20, and the interior area of the sleeve 12 just downhole of the tool 20. It will be appreciated by those of ordinary skill in the art that the collet 26 needs to move relative to the sleeve 12 only to the degree set by the mechanism 46 and/or the J-slot pattern 48 in order to open and close the ports 16 (with respect to dimensions of typical completion systems, the degree of movement delineated by the mechanism 46 is on the order of a few inches). Furthermore, it is noted that even if it is desired to space the end 24 of the tool 20 some distance from the ports 14, the movement required by the tool 20 relative to the sleeve 12 would still be on the same order as noted-above (a few inches) and any of the treatment media in the interior passageway of the sleeve 12 would be downhole of the tool 20, such that operation of the system 10 would be essentially unchanged. Advantageously as noted above, the arrangement of the tool 20 with the collet 26 and the indexing mechanism 46 eliminates the need to insert the string 22 further into the string 18 in order to close the sleeve 12, and therefore, the sleeve 12 can be immediately closed following the treatment by pulling out the string 22 without having to first reverse out the treatment media (e.g., proppant slurry), as is required by previous systems. As also noted above, releasing the downhole-directed force on the tool 20 in order to close the sleeve 12 cycles the indexing mechanism 46 back to the unsupported position, as shown in FIG. 4. Continuing to pull out on the string 22 releases the collet 26 from the profile 28, such that the seals 38 can be dumped, i.e., disengaged from the inner diameters of the sleeve 12 and the string 18, as shown in FIG. 5. Once the seals 38 are dumped, operators can begin to reverse out the proppant slurry immediately.

Figure 6:
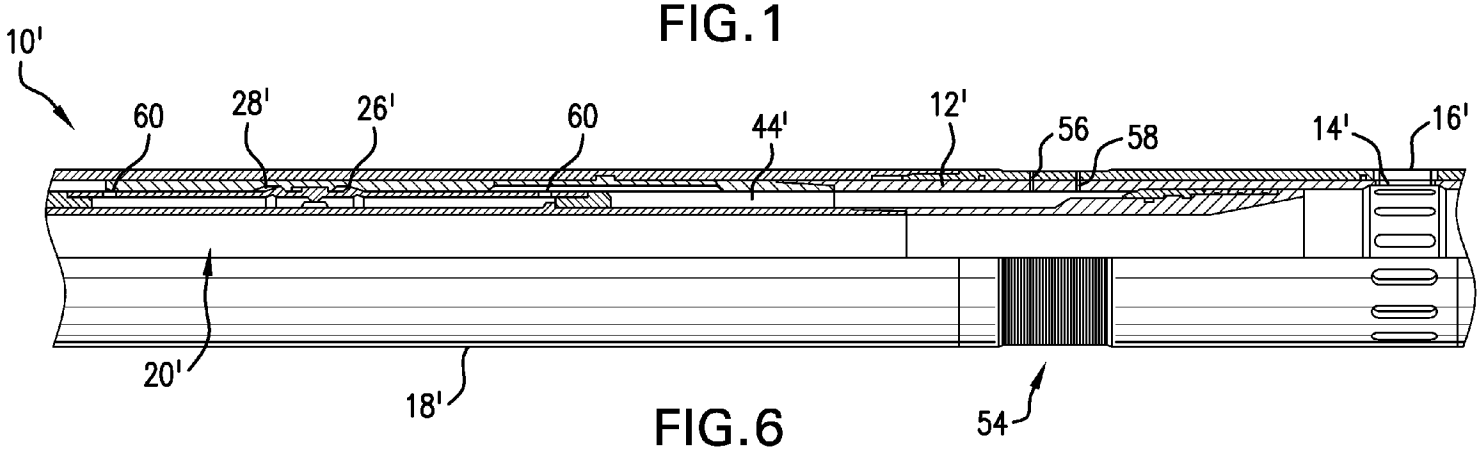
FIG. 6 is a quarter-sectional view of a portion of a system according to another embodiment disclosed herein.

A portion of a system 10' is illustrated in FIG. 6. The system 10' substantially resembles the system 10, with components in the system 10' sharing the same base numeral as their counterparts in the system 10 but followed by a prime symbol. One difference between the systems 10 and 10', is that an open ended tool 20' on a work string 22' substantially resembles the tool 20 on the string 22 with the exception that the tool 20' does not include the filter plugs 42 therein. In order to provide the capability of monitoring the pressure in an annulus 44' formed between the tool 20' and a string 18', the string 18' is equipped with a screen assembly 54 and has one or more ports 56 that are communicable with one or more ports 58 in the sleeve 12'. The screen assembly 54 could be any type of screening or filtering assembly, e.g., wire wrapped, mesh, foam or other fluid permeable material, bead or pellet pack, etc., thus operating similarly to the filter plugs 42 in that the screen assembly filters out solids while permitting fluid flow therethrough. Another difference is that the system 10' includes a plurality of openings 60 in order to facilitate fluid flow through the annulus 44' (specifically past a collet 26' of the tool 20', which otherwise structurally and operationally resembles the collet 26). The remaining components, e.g., a set of ports 14' in the sleeve 12', a set of ports 16' in the string 18', a profile 28' for engaging the collet 26', etc., operate essentially exactly as discussed above with respect to their counterparts in the system 10, but may be slightly structurally altered in order to accommodate the above-discussed differences in the system 10'. The embodiment of the system 10' may provide some advantages over the system 10, such as a more accurate fluid pressure reading under some fluid conditions due to the use of the assembly 54 in lieu of the plugs 42. Another potential benefit is that if multiple valves are included at various locations in a borehole, e.g., multiple instances of the sleeve 12, a separate copy of the assembly 54 can be provided with each valve/sleeve 12, as opposed to the plugs 42 that are associated with the work string 22 and would thus be reused at each valve/sleeve 12. That is, reusing the plugs 42 multiple times could tend to degrade, damage, or clog the plugs 42, potentially even further adversely affecting the pressure measured in the annulus 44.

It is to be appreciated that further modifications to the systems 10 and/or 10' are within the scope of the current invention as disclosed and claimed. For example, systems according to the current invention could be arranged such that movement in the up-hole direction opens the sleeves as opposed to closing (e.g., enabling zones to be fractured from top-to-bottom). As another example, the respective arrangement of various parts could be exchanged, e.g., the collet 26 could be located with the sleeve 12 and the profile 28 with the tool 20, or the seals 38 could be inverted seals located at the inner diameter of the sleeve 12. In lieu of the J-slot pattern 48, some other means for setting relative indexed movement, such as by use of a cam or other member having an engagement surface of varying dimension. In another embodiment, a landing profile or seat could be located just downhole from the ports 16 and arranged to receive a ball, plug, or other obstruction. By plugging or obstructing flow through the interior passage 17 downhole of the ports 16, the treatment media will be more efficiently directed through the ports 16. In one embodiment, neither the screen assemblies 54 nor the filter plugs 42 are employed, but filtered fluid communication between the interior passage 17 and the annulus 44 is provided by rearranging the seal elements 38 as filter elements. That is, modified seal elements 38 or other filter elements could be arranged to permit at least some fluid flow into the annulus 44 while filtering or screening solids from the flow. Specifically, the modified elements 38 or other filter elements could be dimensioned to leave a small radial gap between the tool 20 and the sleeve 12 that permits fluid flow therethrough but blocks solid particles sized greater than the gap. In another embodiment, the modified elements 38 or other filter elements could engage between both the tool 20 and the sleeve 12 and be made from a fluid permeable, but solid-inhibiting or solid-impermeable material, e.g., those materials previously listed for the filter plugs 42. Thus, the use of modified seal elements 38 as, or replacement of the seal elements 38 with filter elements enables essentially the same functionality as discussed above with respect to the plugs 42 and the screen assembly 54. In other embodiments, the system could be arranged such that there is no screen or filter assemblies and/or no fluid communication with the annulus 44. Those of ordinary skill in the art will appreciate the above-described and other alternatives and modifications.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited. Moreover, the use of the terms first, second, etc. do not denote any order or importance, but rather the terms first, second, etc. are used to distinguish one element from another. Furthermore, the use of the terms a, an, etc. do not denote a limitation of quantity, but rather denote the presence of at least one of the referenced item.

What is claimed is:

1. A treatment system, comprising:

a first tubular having at least one port therein;

a valve member disposed with the first tubular and operatively arranged to control fluid flow through the at least one port;

a second tubular disposed radially within the first tubular and terminating at an end opening into an interior passage of the first tubular for enabling a treatment media to be supplied through the second tubular into the first tubular, and through the at least one port when the at least one port is open;

a passive seal assembly disposed radially between the first and second tubulars for fluidly sealing an annulus formed between the first and second tubulars from the end of the second tubular;

a filtered port disposed uphole of the seal assembly through the second tubular communicating pressure from an inside dimension of the second tubular to the annulus between the first tubular and the second tubular; and a tool disposed with the second tubular in operable communication with the valve member.

2. The system of claim 1, wherein the seal assembly and the end are both positioned up-hole of the at least one port.

3. The system of claim 2, wherein the tool is configured such that after engaging and opening the valve member, movement of the tool via the second tubular in solely an up-hole direction enables the valve member to be moved to a closed position.

4. The system of claim 2, wherein the seal assembly is configured to retain a sealed engagement between the first and second tubulars while the valve member is opened and closed.

5. The system of claim 1, further comprising a releasable member disposed between the tool and the valve member for releasably coupling the tool and the valve member together for enabling movement of the tool to actuate the valve member.

6. The system of claim 5, wherein the releasable member includes a collet releasably engageable in a corresponding profile.

7. The system of claim 5, wherein the releasable member is also operatively arranged to indicate that the tool and the valve member have engaged via the releasable member.

8. The system of claim 5 further comprising a support that is movable between at least two positions with respect to the releasable member for selectively supporting the releasable member, the releasable member becoming unreleasable when supported by the support.

9. The system of claim 8, wherein a position of the support relative to the releasable member is controlled by an indexing mechanism.

10. The system of claim 9, wherein the indexing mechanism includes a J-slot pattern defining the at least two positions.

11. The system of claim 10, wherein the indexing mechanism is operatively arranged to cycle through the at least two positions for the support as a result of a suitable force being applied to the releasable member via the second tubular.

12. The system of claim 1, wherein the treatment media is a proppant slurry for performing a fracturing operation.

13. The system of claim 1, wherein the end of the second tubular opens axially into the first tubular.

14. A method of performing a treatment operation comprising:

positioning an inner tubular within an outer tubular, the outer tubular having at least one port therein and a valve member for controlling flow through the at least one port, the inner tubular having a tool in operable communication with the valve member, the inner tubular terminating at an end opening into an interior passage of the outer tubular;

engaging a passive seal assembly between the inner and outer tubulars, the seal assembly sealing off an annulus formed between the inner and outer tubulars from the end of the inner tubular;

porting pressure between an inside dimension of the inner tubular and the annulus between the inner tubular and the outer tubular while preventing solids in media in the inner tubular from entering the annulus;

actuating the valve member with the tool in order to control fluid flow through the at least one port; and supplying a treatment media through the inner tubular into the interior passage via the end of the inner tubular and through the at least one port when the at least one port is open.

15. The method of claim 14, wherein positioning the inner tubular includes placing the seal assembly in a position up-hole from the at least one port.

16. The method of claim 14 further comprising closing the at least one port and thereafter reversing out the treatment media remaining within the inner and outer tubulars.

17. The method of claim 14, wherein manipulating the valve member includes releasably engaging the valve member with a release member disposed with the tool and translating movement of the tool to the valve member via the release member.

18. The method of claim 14, further comprising shifting the valve member to a closed position with the tool for closing the at least one port after engaging the valve member with the tool and shifting the valve member to an open position solely by pulling out the tool.

19. The method of claim 14, further comprising communicating a fluid pressure associated with the treatment media through the annulus.

* * * * *